United States Patent [19]

Theurer et al.

[11] 4,152,990

[45] May 8, 1979

[54] MOBILE TRACK TIE TRANSPORT APPARATUS

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 844,638

[22] Filed: Oct. 25, 1977

[30] Foreign Application Priority Data

Nov. 5, 1976 [AT] Austria ..... 8249

[51] Int. Cl.[2] ..... B65G 7/12

[52] U.S. Cl. ..... 104/6; 294/67 BB; 414/626

[58] Field of Search ..... 104/3, 5, 6; 214/8.5 C, 214/658; 294/67 BB, 67 BC, 87 R; 221/297, 298

[56] References Cited

U.S. PATENT DOCUMENTS

| | | | |
|---|---|---|---|
| 3,473,482 | 10/1969 | Pouget | 104/6 |
| 3,490,622 | 1/1970 | Brackin | 214/658 |
| 4,046,077 | 9/1977 | Theurer et al. | 104/6 |

FOREIGN PATENT DOCUMENTS

| | | | |
|---|---|---|---|
| 831771 | 3/1960 | United Kingdom | 221/297 |

*Primary Examiner*—Francis S. Husar
*Assistant Examiner*—Ross Weaver
*Attorney, Agent, or Firm*—Kurt Kelman

[57] ABSTRACT

A mobile apparatus for transporting track ties comprises a traveling gantry with a frame on which the track ties are received, stored and transported. This frame includes a tie carrier frame mounted for vertical adjustment on the gantry frame, two tie holders mounted on the carrier frame in superposed relationship for simultaneously receiving, storing and transporting two superposed layers of ties, each tie holder having a pair of tie engaging elements arranged for movement transverse to the direction of track elongation into engagement with respective tie ends in a respective layer, the vertical spacing between the pairs of tie engaging elements corresponding to that of the superposed layers of ties, and a separate drive for transversely moving the tie engaging elements of each tie holder. A common power source is connected to the transverse moving drives, a drive for moving the gantry in the direction of track elongation and a drive for vertically adjusting the tie carrier frame on the gantry frame.

8 Claims, 3 Drawing Figures

MOBILE TRACK TIE TRANSPORT APPARATUS

Figure 1:
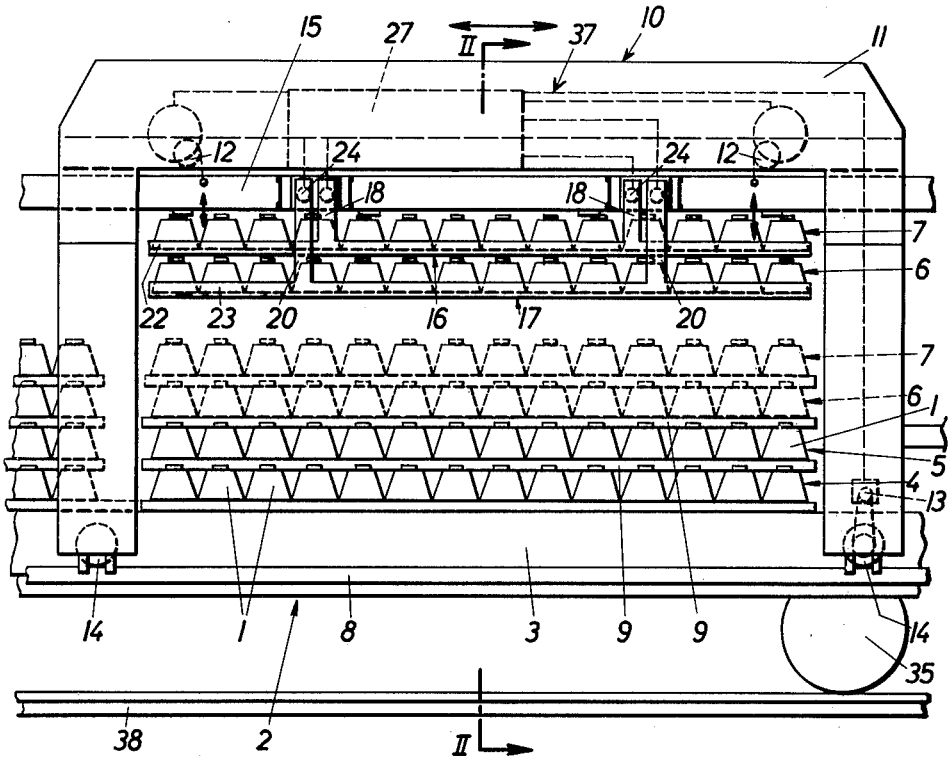

The present invention relates to improvements in a mobile apparatus for transporting track ties.

In our U.S. Pat. No. 4,046,077, dated Sept. 6, 1977, we disclose a track renewal method and apparatus which includes a flat car on which ties are stored and a traveling gantry arrangement for receiving and transporting the ties in the direction of track elongation.

Known mobile apparatus for transporting track ties comprises a traveling gantry arrangement including a gantry frame having means for receiving, storing and transporting track ties extending in a direction transverse to the direction of track elongation, the track tie receiving, storing and transporting means including a tie carrier frame mounted for vertical adjustment on the gantry frame and a tie holding means mounted on the carrier frame for receiving, storing and transporting a layer of ties positioned in succession in the transverse direction. This tie holding means comprises pairs of cooperating tie engaging elements arranged for movement transverse to the direction of track elongation into engagement with respective ones of the ends of the ties. A common power source, such as a hydraulic sump, is connected to a drive for transversely moving the tie engaging elements, a drive for moving the gantry arrangement in the direction of track elongation and a drive for vertically adjusting the tie carrier frame on the gantry frame. Such an apparatus has been described, for example, in the Sept. 1975 issue of the official publication of the Austrian Federal Railroads "Die OBB in Wort und Bild" (The Austrian Federal Railroads in Word and Picture). This apparatus has been successfully used, particularly in connection with modern track renewal trains of high capacity. With such track renewal trains, old ties and rails are continuously replaced by new ties and rails, the old ties being continuously removed from, and the new ties delivered to, the renewal site by means of freight cars whereon the ties are stored in several superposed layers in a direction transverse to the direction of track elongation. Each of these freight cars have guide rails along the sides of the cars whereon the gantry arrangement runs to transport the ties to and from the renewal site. The capacity of these renewal trains is so great that it is necessary to provide a number of such tie transport arrangements, which is expensive in terms of acquisition costs, operating costs and labor costs.

It is the primary object of this invention to provide an apparatus for transporting track ties of the indicated type, which considerably increases the operative speed while affording important economies, particularly in their use with track renewal trains.

The above and other objects are accomplished in accordance with the invention by providing two tie holding means mounted on the carrier frame in superposed relationship for simultaneously receiving, storing and transporting two superposed layers of ties, each of the tie holding means having a pair of tie engaging elements arranged for movement transverse to the direction of track elongation into engagement with respective ones of the ends of the ties in a respective one of the layers, the vertical spacing between the pairs of tie engaging elements corresponding to that of the superposed layers of ties.

An important advantage of this combination resides in the fact that twice the number of ties are transported at one time than could be transported with the known apparatus. Furthermore, the apparatus has an unexpectedly simple construction and costs only a little more, one tie carrier frame being sufficient for both tie holding means. Not only is the capacity of the tie transport apparatus considerably enhanced but so is its range when used in connection with tie laying apparatus so that ties may be delivered from individual freight cars of the track renewal train to the tie laying site with a relatively small number of gantry arrangements, thus providing further economies. In addition, the increased load on the gantry transporting twice the number of ties over the same length of gantry frame enhances the stability of the gantry as it is driven along the train cars, thus increasing the safety of the operation.

The vertical spacing of the two tie holding means provided by the present invention may be so selected that the spacing of the two superposed layers of ties need not be changed and the elongated spacing bars provided between the layers for reasons of safety and to avoid damage to the metallic rail fastening elements mounted on the ties need not be disturbed. On the other hand, the separate transverse moving drives for the tie engaging elements of each pair make it possible to discharge the ties of each layer separately and successively so that the ties may be delivered to a single endless conveyor or the like.

Figure 3:
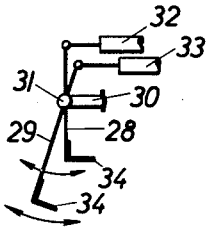
Figure 2:
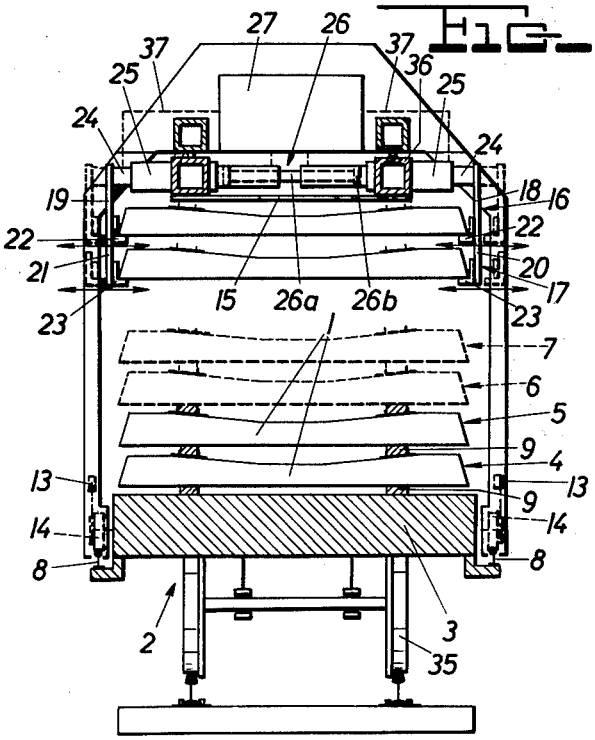

The above and other objects, advantages and features of this invention will become more apparent from the following detailed description of now preferred embodiments thereof, taken in conjunction with the accompanying drawing wherein FIG. 1 is a diagramatic side view of part of a flat car on which track ties extending in a direction transverse to the direction of track elongation are stored and shows a traveling gantry arrangement mounted on the loading platform of the car for movement in the direction of track elongation for receiving, storing and transporting the ties, FIG. 2 is a cross section along line II-II of FIG. 1; and FIG. 3 schematically shows another embodiment of the drives for transversely moving the tie engaging elements of each tie holding means.

Referring now to the drawing and first to FIG. 1, there is shown flat car 2 which is mounted on wheels 35 for mobility on track rails 38 and on which are stored four superposed layers 4, 5, 6 and 7 of ties 1 extending in a direction transverse to the track. The flat car is part of a track renewal train of the type disclosed, for example, in the above-identified patent. The four layers of ties are stored on the loading platform of car 2 along the sides of which extend guide rails 8 on which gantry arrangement 10 is movable in the direction of track elongation. Elongated wooden spacing bars 9 are mounted between the layers of ties, these spacing bars extending through the grooves of ribbed fastening plates mounted on the ties. In this manner, the ties are secured against accidental displacement in a transverse direction during the movement of the train.

Gantry arrangement 10 includes gantry frame 11 having means for receiving, storing and transporting the track ties stored on car 2, this means including tie carrier frame 15 mounted for vertical adjustment on gantry frame 11. A drive for vertically adjusting the tie carrier frame on the gantry frame comprises two cable winches 12 mounted on gantry frame 11 and supporting carrier frame 15 for vertical adjustment. Drive 13 for moving the gantry arrangement in the direction of track elongation is associated with wheels 14 which run of guide rails 8. Two tie holding means 16, 17 are mounted on carrier frame 15 in superposed relationship for simultaneously receiving, storing and transporting two superposed layers 6 and 7 of ties 1.

As best illustrated in FIG. 2, each tie holding means has a pair of tie engaging elements 18, 22; 19, 22; and 20, 23; 21, 23 arranged for movement transverse to the direction of track elongation into engagement with respective ones of the ends of ties 1 in a respective one of layers 6 and 7. The vertical spacing between the pairs of tie engaging elements corresponds to that of the superposed layers of ties.

In the illustrated embodiment, the tie engaging elements of each pair are comprised of carrier arm 18, 19 and 20, 21, respectively, and L-shaped member 22 and 23, respectively, the L-shaped members 22 being affixed to carrier arms 18 and 19, and the L-shaped members 23 being affixed to carrier arms 20 and 21. The L-shaped members are angle irons arranged to subtend the respective tie ends and the tie engaging elements of each pair are arranged mirror-symmetrically with respect to a median perpendicular plane in the direction of track elongation. The subtending arm of angle irons 22, 23 extends substantially parallel to the loading platform 3 of car 2 and the ties stored thereon and is directed towards the respective ends of ties 1. Since these subtending arms project inwardly from the carrier arms of the tie engaging elements, they may be moved transversely towards the tie ends without interfering with each other. The L-shaped members 22 and 23 of the tie engaging elements extend in the direction of track elongation substantially the entire length of the carrier frame so that they may grip the entire layer of ties.

This arrangement of the tie engaging elements is very simple in structure and quite practical because it permits the load of the relatively heavy ties to be distributed evenly, particularly where concrete ties are involved. With the use of angle irons, the tie engaging elements will not only grip the ties as one arm of the L-shaped members subtends the tie ends but the ties will also be laterally guided and secured against dropping during their transport.

According to this invention, a separate drive is provided for transversely moving the tie engaging elements of each tie holding means. In the embodiment of FIG. 2, each drive comprises transversely movable guide part 24 for each tie engaging element, the tie engaging element 18, 22 and 20, 23, as well as 19, 22 and 21, 23 arranged for engagement with the same ends of ties 1 being affixed to a respective guide part 24. Transverse guide 25 is mounted on longitudinal strut 36 of rectangular cross section, which forms part of the carrier frame and supports and guides each guide part 24. In the illustrated embodiment, each guide part 24 is a cylinder of a hydraulic motor constituting the drive 26 which includes fixed piston rod **26*a* on which there are mounted fixed pistons 26*b* on which guide cylinders 24 for each pair of tie engaging elements glides. A common power source constituted by a hydraulic fluid sump 27 delivers hydraulic fluid through a hydraulic fluid circuit 37 indicated in broken lines to drives 4, 12 and 26. By selectively supplying hydraulic fluid to the respective chambers of guide cylinders 24 on either side of pistons 26*b*, the tie engaging elements may be moved independently of each other between the transverse positions shown in full and broken lines in FIG. 2**.

This drive arrangement has the advantage of aiding in the even load distribution over carrier frame 15 since the tie load is transmitted by the guide parts to a relatively large area.

In the drive arrangement schematically shown in FIG. 3, the tie engaging elements also are comprised of a carrier arm 28 or 29, respectively, to which is affixed L-shaped tie end gripping member 34. The tie engaging elements arranged for engagement with the same ends of the ties are mounted on carrier frame 15 for pivoting about common pivot axis 31 on support 30 which mounts the pivot axis on the carrier frame. The pivot axis extends in the direction of track elongation, and the drive for transversely moving each of the tie engaging elements 28, 34 and 29, 34 is a respective hydraulic motor 32, 33 connected to a respective tie engaging element for pivoting it about the common pivot axis. This enables each tie engaging element to be moved independently of each other.

This embodiment may advantageously be used in existing tie transport gantry arrangements to be adapted to the transport of several superposed layers of ties since it will require no more than the installation of the pivoting arrangements on each side of the carrier frame.

As is shown in FIG. 1, the illustrated tie holding means each comprises a pair of tie engaging elements comprised of two carrier arms 18, 20 and 19, 21, respectively, and an L-shaped member 22 and 23 affixed to the two carrier arms of each tie engaging element and arranged to subtend the respective tie ends. The L-shaped members of the tie engaging elements of each of the superposed tie holding means extend in the direction of track elongation and are substantially of the same length, the two carrier arms 18 of the tie engaging elements of one of the tie holding means being arranged between the two carrier arms 20 of the tie engaging elements of the other tie holding means. This produces a centered load on carrier frame 15 and drives 12 when the superposed layers of ties 1 are successively gripped and lifted, and assures that the same number of ties is moved from the superposed layers of ties.

The operation of the apparatus for lifting and transporting two groups of ties stored on car 2 is superposed layers 6 and 7 of ties 1 arranged successively in the direction of track elongation will now be explained in connection with the embodiment of FIGS. 1 and 2:

The gantry arrangement 10 is moved along guide rails 8 until gantry frame 11 is in alignment with the groups of ties to be lifted and moved. After the gantry frame has been so positioned on car 2, vertical adjustment drives 12 are operated to lower tie carrier frame 15 until the inwardly projecting arms of L-shaped members 22 are in the same plane as the lower sides of ties 1 of layer 7 so as to subtend the same when members 22 are transversely moved towards each other by drives 26. The tie-engaging members 22 are moved together until their vertical arms contact the ends of the ties so as to grip the ties therebetween. Subsequently, drives 26 moving L-shaped members 23 towards each other are operated to grip ties 1 of layer 7 therebetween. In other words, the tie engaging elements are moved from their rest position shown in broken lines in FIG. 2 into their operative position shown therein in full lines. After the two layers of ties have thus been firmly gripped between tie holding means 16 and 17, tie carrier frame is lifted by drives 12 into the position shown in full lines in FIG. 1 wherein the layers 6 and 7 of ties 1 have been lifted off their stored position on car 2. Gantry arrangement 10 is now driven on wheels 14 in the direction of track elongation to transport the ties held on carrier frame 15 to a desired location, for instance a conveyor delivering successive ones of the transported ties to a tie laying site or to another gantry for further transport of the ties, all in a manner well known in modern track renewal trains.

The embodiment of FIG. 3 operates in the same manner, except that the tie engaging elements are moved together by pivoting rather than a straight-line motion.

While two superposed tie holding means have been described and illustrated herein, it will be understood by those skilled in the art that three or four such superposed tie holding means could be mounted on the tie carrier frame for the simultaneous transport of a corresponding number of layers of ties stored on the car. Also, instead of using continuous members 22, 23, 34 for subtending all the tie ends, it would be possible to use separate members for each tie. The use of the continuous tie gripping members has the advantage that, while the ties are engaged, they are simultaneously aligned.

As is apparent from FIG. 1, ties 1 are advantageously stored on loading platform 3 of car 2 in distinct blocks of a succession of ties arranged in superposed layers. In this manner, if each block has the same length as the tie carrier frame, two or more layers of ties of the block are lifted and transported simultaneously. This is of particular advantage when spacing bars 9 between the tie layers are used since the tie layers may be lifted without first removing the spacing bars. Usually, guide elements for these spacing bars are mounted on the loading platform between the blocks of ties.

It may be pointed out that carrier frame 15 may have gripping devices for transporting sections of track in a manner more fully described in the above-mentioned patent so that the gantry arrangement may be used also for the transport of such whole track sections, thus enabling the gantry arrangement to be used for moving away old track sections from a track renewal site and to move individual new ties to this site during a continuous track renewal operation. Such operations are conventional. Also, instead of running the gantry arrangement on guide rails mounted on the train cars, it may be mounted on wheels running on auxiliary rails extending along the track rails or on trackless undercarriages as well as rubber-tired wheels so that the apparatus may also be used in the construction of new track completely independently of any tracks or ballast bed.

What is claimed is:

1. A mobile apparatus for transporting tract ties, which comprises (a) a traveling gantry arrangement including a gantry frame having means for receiving, storing and transporting track ties extending in a direction transverse to the direction of track elongation, the track tie receiving, storing and transporting means including (1) a tie carrier frame mounted for vertical adjustment on the gantry frame, (2) two tie holding means mounted on the carrier frame in superposed relationship for simultaneously receiving, storing and transporting two superposed layers of said ties, each of the tie holding means having a pair of tie engaging elements arranged for movement transverse to the direction of track elongation into engagement with respective ones of the ends of the ties in a respective one of the layers, the vertical spacing between the pairs of tie engaging elements corresponding to that of the superposed layers of said ties, and (3) a separate drive for transversely moving the tie engaging elements of each tie holding means, (b) a drive for moving the gantry arrangement in the direction of track elongation, (c) a drive for vertically adjusting the tie carrier frame on the gantry frame, and (d) a common power source for all the drives.

2. The mobile apparatus for transporting track ties of claim 1, wherein the drives are hydraulic motors and the common power source is a hydraulic fluid supply delivering hydraulic fluid to the hydraulic motors.

3. The mobile apparatus for transporting track ties of claim 1, wherein the tie engaging elements of each pair are comprised of a carrier arm and an L-shaped member affixed thereto and arranged to subtend the respective tie ends, the tie engaging elements of each pair being arranged mirrorsymmetrically with respect to a median plane extending in the direction of track elongation.

4. The mobile apparatus for transporting track ties of claim 3, wherein the L-shaped members of the tie engaging elements extend in the direction of track elongation substantially along the entire length of the carrier frame.

5. The mobile apparatus for transporting track ties of claim 1, wherein each drive for transversely moving the tie engaging elements comprises a transversely movable guide part for each tie engaging element, the tie engaging element arranged for engagement with the same ends of the ties being affixed to the guide part, and a transverse guide on the carrier frame supporting and guiding the guide part.

6. The mobile apparatus for transporting track ties of claim 5, wherein the guide part is a cylinder of a hydraulic motor constituting the drive.

7. The mobile apparatus for transporting track ties of claim 1, wherein the tie engaging elements arranged for engagement with the same ends of the ties are mounted for pivoting about a common pivot axis extending in the direction of track elongation, and the drive for transversely moving each of the tie engaging elements is connected thereto for pivoting the tie engaging element about the common pivot axis.

8. The mobile apparatus for transporting track ties of claim 1, wherein the tie engaging elements of each pair are comprised of two carrier arms and an L-shaped member affixed thereto and arranged to subtend the respective tie ends, the L-shaped members of the tie engaging elements of each of the superposed tie holding means extending in the direction of track elongation and being substantially of the same length, the two carrier arms of the tie engaging elements of one of the tie holding means being arranged between the two carrier arms of the tie engaging elements of the other tie holding means.

* * * * *